US006368467B1

(12) United States Patent
Andrews et al.

(10) Patent No.: US 6,368,467 B1
(45) Date of Patent: Apr. 9, 2002

(54) ELECTRO-PLATING PLASMA ARC DEPOSITION PROCESS

(75) Inventors: Edgar Harold Andrews, Welwyn (GB); Valerij Leontievich Steblianko, Magnitogorsk; Vitalij Makarovich Riabkov, Moscow, both of (RU)

(73) Assignee: Metal Technology, Inc., Mandeville, LA (US)

( * ) Notice: Subject to any disclaimer, the term of this patent is extended or adjusted under 35 U.S.C. 154(b) by 0 days.

(21) Appl. No.: 09/509,193

(22) PCT Filed: Sep. 23, 1998

(86) PCT No.: PCT/GB98/02874

§ 371 Date: Sep. 12, 2000

§ 102(e) Date: Sep. 12, 2000

(87) PCT Pub. No.: WO99/15714

PCT Pub. Date: Apr. 1, 1999

(30) Foreign Application Priority Data

Sep. 23, 1997 (RU) ..... 97116010

(51) Int. Cl.[7] ..... H05F 3/00

(52) U.S. Cl. ..... 204/164; 205/117; 205/118; 205/151

(58) Field of Search ..... 204/224 R, 164; 205/117, 118, 136, 137, 138, 152, 151, 133, 102, 104

(56) References Cited

U.S. PATENT DOCUMENTS 5,700,366 A * 12/1997 Steblianko et al.

* cited by examiner

*Primary Examiner*—Kathryn Gorgos
*Assistant Examiner*—Wesley A. Nicolas
(74) *Attorney, Agent, or Firm*—Dykema Gossett PLLC

(57) ABSTRACT

An electrolytic process for metal-coating the surface of a workpiece of an electrically conductive material includes i) providing an electrolytic cell with a cathode defining the surface of the workpiece and an anode; ii) introducing an electrolyte of an aqueous solution containing one or more water soluble compounds of the metal or metals to be deposited into the zone created between the anode and the cathode in a manner such that the cathode is bathed but not immersed in the electrolyte; and iii) applying a voltage between the anode and the cathode such that an electrical plasma arc is maintained between the anode and cathode during the deposition of the metal-coating onto the surface of the cathode.

12 Claims, 2 Drawing Sheets

ELECTRO-PLATING PLASMA ARC DEPOSITION PROCESS

The present invention relates to a process of electroplating a coating of a metal or an alloy onto a substrate employing an electrolytic cell as in conventional electroplating but which does not use a conventional electroplating regime.

BACKGROUND

The deposition of metal or alloy coatings by electroplating techniques is well known in the art. Electro-plating is typically carried out at voltages of from 5 to 20 volts DC, current densities of from 0.2 to 60 amp/dm$^2$ (more typically 1–10 amp/dm$^2$) temperatures in the range of from 10 to 90° C. and under conditions where the workpiece is completely immersed in the electrolyte solution. It is also common to use sacrificial anodes of the same composition as the plating metal for the purpose of maintaining the electrolyte concentration during the process.

The electro-plating process is relatively slow, typically depositing metal at a rate of from 1 to 5 micrometres/minute in thickness. The electro-plated layer is normally dense (solid and without voids), while its surface finish is normally smooth and reflective towards light. The thickness of electro-plated layers can have almost any value depending upon the time and current density employed. Typical thicknesses would be in the range of from 10 to 50 micrometres.

In 'brush' plating processes, such as the 'Sifco' process (Sifco Industries Inc. of Cleveland, Ohio, USA), higher rates of electro-deposition of up to 20 micrometres in thickness/minute can be attained under favourable conditions. This process uses a porous pad or 'brush' saturated with the electrolyte at high metal concentrations, the pad occupying the space between the anode and the cathode (workpiece). The workpiece is therefore not immersed in the electrolyte as in conventional electro-plating processes. Voltages of from 6 to 20 v are generally employed.

High speed electro-plating can be carried out at very high current density. For example, a deposition rate of 150 micrometres/minute is reported for an iron plating from a $Fe(NH_2SO_3)_2$ solution at a current density of 690 amp/dm$^2$ (Electro-plating Engineering Handbook [Ed. L. J. Durney], Van Nostrand Reinhold, 1984, 4th Edition, pages 767–771).

However, these known processes of electroplating are not suitable for producing intentionally rough or porous coatings which may be desired, for example to provide better mechanical keying if a further coating, for example of paint or plastic, is to be applied. In some circumstances also it may be desirable to deposit a metal coating at a much faster speed than is feasible using known electro-plating process at normal current densities (below 100 amp/dm$^2$). The present invention addresses these matters.

PRIOR ART

In PCT Application No.PCT/IB96/00876, the present inventors describe a process for cleaning and metal-coating electrically conducting surfaces which employs one or more anodes which are made of the metal or metals to be deposited. The method involves transferring metal from the anode or anodes to the workpiece which forms the cathode in an electrolytic cell. The process is operated in a regime in which the DC current decreases or remains substantially constant with increasing voltage and in which discrete gas bubbles are formed at the workpiece. The electrolyte is sprayed or jetted on to the surface of the workpiece through one or more holes in the anode. Although the workpiece may be immersed in the electrolyte, it is preferred that it is not. In the prior Patent Application it is not necessary that the electrolyte should contain any soluble salt or compound of the metal being deposited, since the metal which is deposited onto the surface of the workpiece is transferred from the anode or anodes, which must be of the same composition as the metal or metals to be deposited. The process described in the present Application is distinguished from the said earlier Application in that (a) it involves the conventional deposition of metal from the electrolyte solution and (b) it is carried out using an anode which may be made from any electrically conducting material.

Electro-plating without immersion of the workpiece is known in the 'brush' plating process as mentioned above and is also taught, for example, in CA-A-1165271 in which the electrolyte is pumped or poured through a box-shaped anode with an array of holes in its base so as to impinge on the workpiece situated or moving below the anode-box. The benefit of this arrangement is that only one side of the workpiece is plated instead of the whole, as would occur in a bath plating method. It also avoids the use of a consumable anode.

With regard to operation in a plasma or spark-discharge regime, there are a number of patents in which the purpose is solely to clean a metal surface. Examples are GB-A-1399710, SU-A-1599446, SU-A-1244216 and GB-A-1306337.

With regard to coating processes, micro-arc processes have been described for the deposition of oxide and silicate coatings on metals. In these processes the coatings which are deposited are non-metallic and take place at the anode, not the cathode as in the present invention. (See for example, U.S. Pat. No. 3834999; A. V. Timoshenko et al., Protection of Metals, Vol. 30, No. 2, 1944, pp 175–180).

We have now developed an electro-plating method in which metal is deposited from an electrolytic solution as in a conventional electroplating process, but in the presence of an electrical plasma arc discharge.

SUMMARY OF THE INVENTION

According to the present invention there is provided an electrolytic process for metal-coating the surface of a workpiece of an electrically conductive material, which process comprises:

i) providing an electrolytic cell with a cathode comprising the surface of the workpiece and an anode;

ii) introducing an electrolyte comprising an aqueous solution containing one or more water soluble compounds of the metal or metals to be deposited into the zone created between the anode and the cathode in a manner such that the cathode is bathed but not immersed in the said electrolyte; and iii) applying a voltage between the anode and the cathode, characterized in that iv) an electrical plasma arc is maintained between the anode and cathode during the deposition of the metal-coating onto the surface of the cathode.

DETAILED DESCRIPTION OF THE INVENTION

Figure 1:
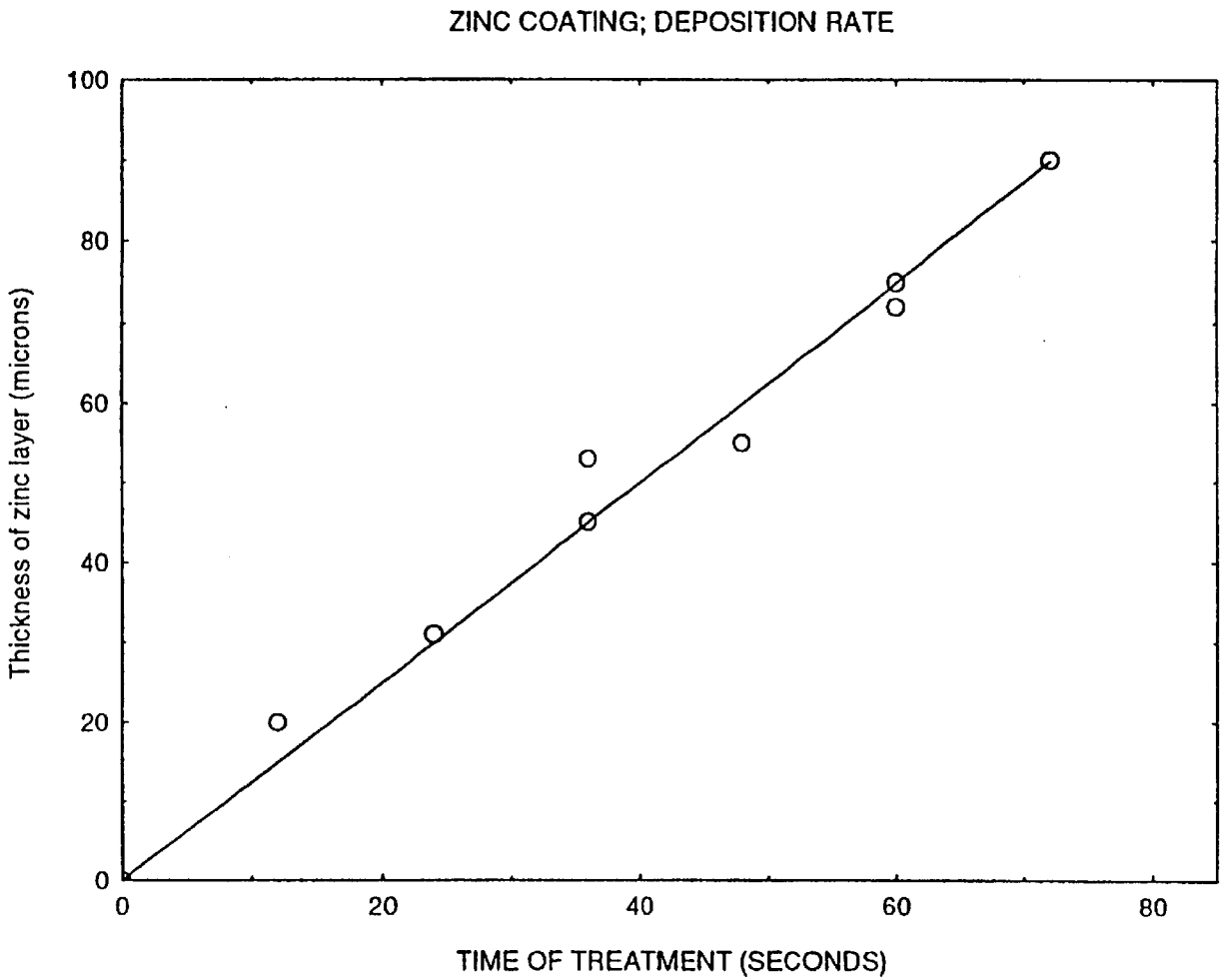
FIG. 1 illustrates the deposition of zinc as a function of time as described in Example 3.

Although features (i) to (iii) detailed above are known in the electro-plating art, feature (iv) is considered to be novel both alone and in combination with features (i) to (iii).

In carrying out the process of the present invention, the anode (or plurality of anodes) may be made from any electrically conducting material, and the cell is operated substantially in a direct current w mode, although polarity reversal may optionally be used during a minor part of the time of operation.

To operate the process of the invention, a DC voltage is applied between the anode and the cathode (workpiece) and the electrolyte is introduced into the gap between the anode and the cathode by any suitable means such as flowing, spraying, atomising, jetting or dropping, whether through one or more holes in the anode or otherwise, but without producing immersion of the workpiece.

It is necessary to strike (that is, initiate) the arc and this may be done in several ways. One effective way is to set the voltage and electrode separation and then introduce the electrolyte. initially at a rate (the 'flow-rate') high enough to prevent arc formation between the anode and the cathode. The flow-rate is then progressively decreased until the plasma arc occurs, becoming visible to the naked eye, at which point rapid deposition of the metal or metal alloy coating occurs. The plasma arc does not necessarily fill the gap between the anode and the cathode; there is normally a considerable dark space on the anode side. Metal deposition rates can exceed a thickness of 60 micrometres per minute at current densities no greater than 100 amp/dm$^2$ compared with a normal value of about 10 micrometres/minute and up to 20 micrometres/minute for fast conventional electroplating processes carried out at comparable current density. The nature of the coating obtained using the method of the invention may be different from that obtained using conventional electro-plating process, as is described later.

As the flow-rate is further reduced beyond the point at which an arc is struck, the intensity of the plasma arc increases until eventually it reaches a maximum and begins to fall again. Once the flow-rate is reduced to zero, neither arc formation nor deposition occurs. For any fixed values of other material variables (namely voltage, anode-to-cathode distance, and electrolyte temperature) there is therefore a range of flow-rates over which the process can be operated. This range will depend upon the values chosen for the different variables, as well as on the electrolyte composition.

It is to be understood that the method described for striking the arc is by way of example only and that other methods can be used, such as a gradual increase of the voltage whilst maintaining other variables constant.

Optionally, sacrificial anodes of the metal or metals to be deposited may be disposed within the cell and in contact with the electrolyte to help maintain the electrolyte concentration as is well known in the art.

The workpiece may be of any shape or form as long as the anode can be kept at a substantially constant distance from the workpiece. For example, the workpiece comprises a metal strip, metal sheet, metal slab or a pipe. The surface of the workpiece which is electroplated in accordance with the invention is that of the cathode.

Ranges of Variables

The ranges of variables within which useful results can be obtained are as follows:

Voltages

The range of voltages employed in the method of the present invention is generally in the range of from 50 to 300V DC, which is relatively high and considerably higher than the range of 5 to 20V DC used in conventional electroplating processes.

Current Density

The current density may vary in the range of from 1 to 200 amp per square decimetre of anode (amp/dm$^2$).

Electrolyte Flow Rate

The flow rates may vary quite widely, between 0.2 and 25 litres per minute per square decimetre of anode (1/min.dm$^2$)

Electrolyte

The electrolyte comprises an aqueous solution of one or more compounds of the metal or metals to be coated. Typical concentrations are from 1% by weight to saturation. Typical examples of solutions which may be used are as follows:

| | |
|---|---|
| for zinc | zinc sulphate or zinc nitrate |
| for aluminium | aluminium sulphate or aluminium nitrate |
| for iron | iron ammonium sulphate |
| for lead | lead nitrate |
| for copper | copper sulphate |

Electrolyte Temperature

Temperatures in the range of from 10 to 90° C. can usefully be employed. It will be understood that appropriate means may be provided in order to heat or cool the electrolyte and thus maintain it at the desired operating temperature.

Inter-electrode Separation

The anode-to-cathode separation, or the working distance, is generally within the range of from 3 to 30mm, preferably within the range of from 5 to 20 mm.

It will be understood that arcing cannot necessarily be obtained with any combination of variables within the ranges detailed above, but only under some combinations thereof. The combinations which will work may depend on the electrolyte composition, the metal to be coated, the shape, size and mass of the workpiece, and the configuration of the electrolytic cell. In order to establish whether a given combination of variables will initiate and support arcing, all that is required is to fix all the named variables except one and then vary that last variable over its range. As indicated earlier, the easiest parameter to vary is the electrolyte flow-rate.

The Coatings

The coatings may be of any metal or combination of metals which have soluble salts or soluble ionisable compounds. Typically the coating obtained will consist of two layers which merge with each other, namely a solid continuous layer adjacent to the original workpiece surface (bottom layer) and a porous layer adjacent the solid continuous layer (top layer). This solid/porous dual'structure provides both a solid barrier to corrosion and a porous top layer which provides an excellent surface for mechanical keying of subsequent coatings (e.g. plastic or paint) and provides protection against mechanical damage. The structure of the coating will depend upon the precise conditions employed and coatings of a different structure from that described above may also be obtained, for example, completely solid coatings.

Rates of Deposition

The maximum deposition rate is fast when compared to conventional electro-deposition methods at comparable current densities, and can exceed 1 micrometre per second (60 micrometres per minute). Coating thickness can be controlled by, among other things, traversing the workpiece through the cell [working zone] so that it moves relative to the fixed anode but at a constant separation from the anode. The time spent in the working zone will be inversely proportional to the speed of traverse and the coating thickness will be pro rata to the said time. The workpiece may be passed several times through the same working zone, or through several working zones sequentially.

The high coating speeds available mean that the process is particularly useful for on-line or continuous-process treatment of metals.

The present invention will be further described with reference to the following Examples.

EXAMPLE 1

A pre-cleaned mild steel plate 0.31 cm (0.125) inch thick forming the cathode in an electrochemical cell was coated with a mixture of zinc and aluminium under the following conditions.

| | |
|---|---|
| Voltage: | 160V |
| Current: | 42A |
| Anode: | Stainless steel; area 48cm$^2$ with 2.4 mm diameter holes |
| Electrolyte: | Equal parts of saturated solutions of $ZnSO_4$ and $A1_2(S0_4)_3$ |
| Flow Rate: | 2.61/min at 70 deg C. |
| Electrode Separation: | 12 mm |

After a treatment time of 80 seconds, a layer of zinc/aluminium approximately 27 micrometres thick was deposited onto the cathode consisting of a bottom solid (compact) layer adjacent to the steel cathode substrate and a top porous layer. When tested for coating adhesion to the substrate using ASTM 'pull off' test No. D4541-95, the average pull-off stress was 39 MPa which exceeds industry standards.

When tested for cathodic disbandment by industry standard tests, the disbanded distance was under 2 mm after 24 hours and under 3 mm after 48 hours, which values are far superior to industry averages values of 8 mm and 12 mm, respectively.

EXAMPLE 2

A thin pre-cleaned strip of mild steel 19 mm wide and 2.1 mm long forming the cathode of an electrochemical cell was coated with a mixture of zinc and aluminium as in Example 1 under the following conditions:

| | |
|---|---|
| Voltage: | 150 V |
| Current: | 10A |
| Anode: | Stainless steel; area 48 cm$^2$ with 2.4 mm diameter holes |
| Electrolyte: | Equal parts of saturated solutions of $ZnSO_4$ and $Al_2(SO_4)_3$ |
| Flow Rate: | 2.61/min at 70 deg C. |
| Electrode Separation: | 10 mm |

The steel strip was passed through the working zone of the cell 5 times, each pass taking 36 seconds. This corresponded to a 10 second total treatment time for any one area of the cathode.

A layer of zinc/aluminium approximately 6 to 10 micrometres was deposited on the cathode.

EXAMPLE 3

The general procedure of Example 2 was repeated using a mild steel strip sample 6.2 cm wide and 21 cm long and a saturated zinc sulphate solution as electrolyte. The progressive deposition of zinc, in terms of the thickness of the coating layer, as a function of the time of treatment is shown in FIG. 1. The deposition rate exceeds 1 micrometre per second.

EXAMPLE 4

Figure 2:
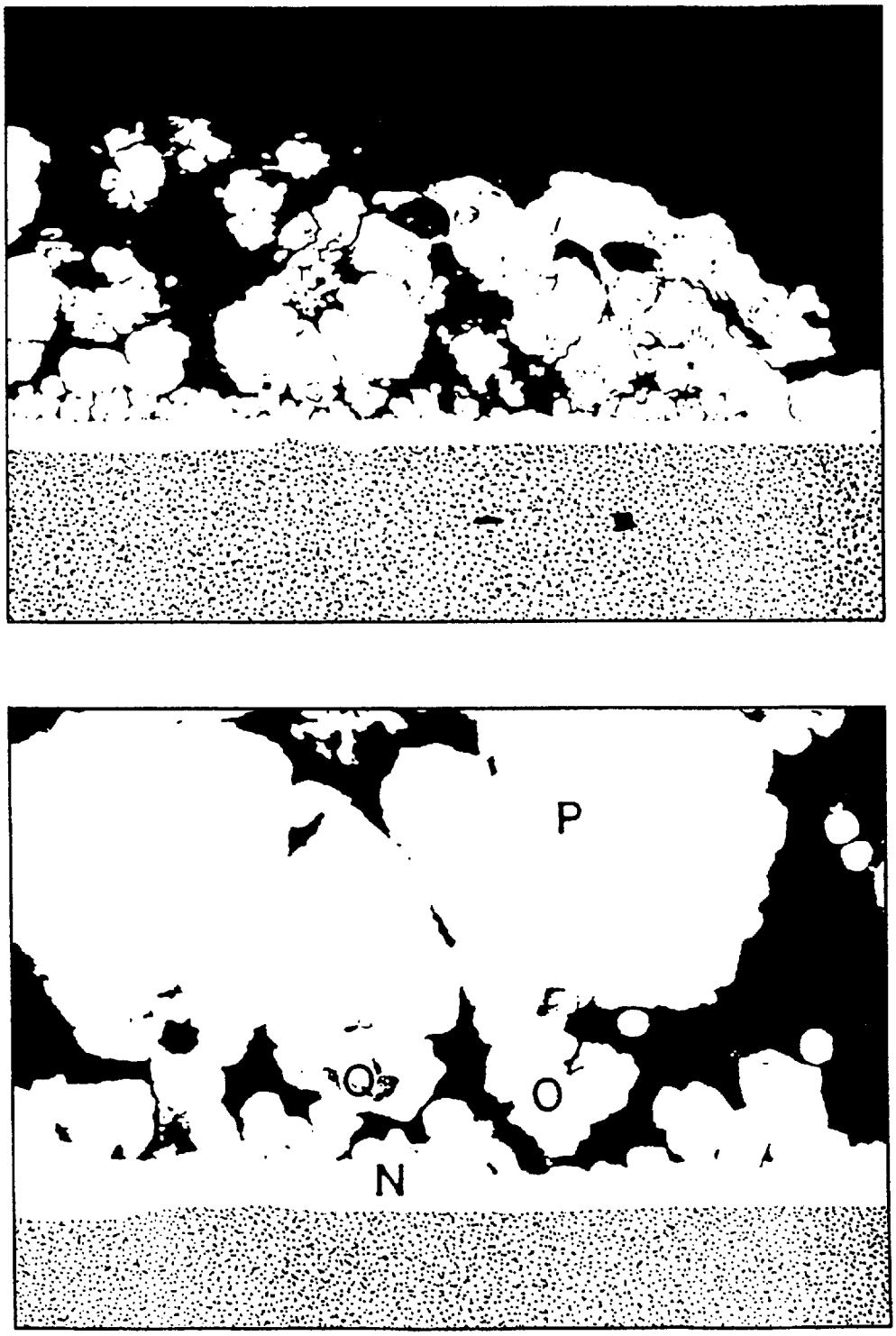
FIG. 2 is an electromicrograph of a cross-section of the zinc layer deposited in Example 4.

The layer of zinc deposited in Example 3 consists of a solid layer (N) approximately 5 micrometres thick adjacent to the steel substrate. This structure is illustrated in the scanned and digitized electron micrograph image of FIG. 2. An EDS (energy dispersive spectrometer) analysis of various areas (N, O, P & Q) in the cross-section showed:

| | |
|---|---|
| N | 2.2% iron in zinc |
| O | 1.0% iron in zinc |
| P | O.3% iron in zinc |
| Q | 1.5% iron, 1.7% sulphur and a moderate amount of oxygen in zinc. |

EXAMPLE 5

The procedure of Example 2 was repeated under the following conditions:

| | |
|---|---|
| Voltage: | 190 V |
| Current: | 20A |
| Electrolyte: | $ZnSO_4$ (saturated solution) |
| Electrode Temperature: | 73° C. |
| Temperature Time: | 125 |

Electron micrographs of a cross-section of the coated steel showed that a solid (non-porous) coating of zinc, some 10 micrometres thick, had been deposited on the steel.

What is claimed is:

1. An electrolytic process for metal-coating the surface of a workpiece of an electrically conductive material, which process comprises:

i) providing an electrolytic cell with a cathode comprising the surface of the workpiece and an anode;

ii) introducing an electrolyte comprising an aqueous solution containing one or more water soluble compounds of the metal or water soluble compounds of the metal or metals to be deposited on the surface of the workpiece into the zone created between the anode and the cathode in a manner such that the cathode is bathed but not immersed in the said electrolyte; and iii) applying a voltage between the anode and the cathode so as to create an electrical plasma arc between the anode and cathode and creating deposition of said metal or metals from said electrolyte onto the surface of the cathode, said anode being made of a metal or metals other than said metal or metals in said electrolyte.

2. A process as claimed in claim 1 in which a plurality of anodes is used.

3. process as claimed in claim 1, wherein the voltage is in the range of from 50 to 300V DC.

4. A process as claimed in claim 1, wherein the workpiece has a metal surface or a metal alloy surface.

5. A process as claimed in claim 1, including a step of moving the workpiece relative to the anode during the process.

6. A process as claimed in claim 1, wherein at least one anode is disposed on one side of the workpiece to be treated and at least one anode is disposed on the opposite side of the workpiece to be treated, whereby the opposite sides of the workpiece are metal-coated.

7. A process as claimed in claim 6 wherein the workpiece comprises a metal strip, a metal sheet or a metal slab.

8. A process as claimed in claim 1, wherein the workpiece is a pipe.

9. A process as claimed in claim 8 wherein at least one anode is disposed outside the pipe and at least one anode is disposed inside the pipe, so that both the inside and the outside of the pipe are coated.

10. An electrically conductive workpiece which has been metal-coated by a process as claimed in claim 1, wherein the coating consists of a solid layer in contact with the workpiece and a porous layer in contact with the solid layer.

11. A metal-coated electrically conductive workpiece as claimed in claim 10 wherein the workpiece is formed from carbon steel and the coating comprises zinc or a zinc/aluminium alloy.

12. A metal-coated electrically conductive workpiece as claimed in claim 10 wherein the solid layer is an alloy which contains atoms of the material of the workpiece which are derived from the said workpiece.

* * * * *